United States Patent [19]

Storz et al.

[11] 4,220,835

[45] Sep. 2, 1980

[54] ELECTRICAL SWITCH CONSTRUCTION

[75] Inventors: Werner Storz; Siegfried Wolpert, both of Rietheim-Weilheim; Kuno Futterknecht, Emmingen-Liptingen, all of Fed. Rep. of Germany

[73] Assignee: J. & J. Marquardt, Fed. Rep. of Germany

[21] Appl. No.: 941,015

[22] Filed: Sep. 11, 1978

[30] Foreign Application Priority Data

Sep. 10, 1977 [DE] Fed. Rep. of Germany ..... 2740902

[51] Int. Cl.[2] ..... H01H 21/44

[52] U.S. Cl. ..... 200/67 DB; 200/159 A; 200/283

[58] Field of Search ..... 200/76, 250, 275, 67 D, 200/67 DA, 67 DB, 159 A, 283

[56] References Cited

U.S. PATENT DOCUMENTS

| | | | |
|---|---|---|---|
| 2,734,958 | 2/1956 | Immel et al. | 200/67 D |
| 4,035,596 | 7/1977 | Marquardt et al. | 200/67 DB |

*Primary Examiner*—Frederick R. Schmidt

*Attorney, Agent, or Firm*—McGlew and Tuttle

[57] ABSTRACT

An electrical switch, comprises, a casing of a nonconductive material, having first and second spaced apart upstanding supports, with a contact plate of an electrically conductive material having an intermediate spring portion, with an outwardly extending arcuate bulge portion intermediate its length and a bridging member on each side of the spring portion, and an end portion on each end interconnecting the spring portion with at least one end of each bridging member and supported on respective spaced apart supports. The intermediate spring portion is held in an outwardly biased position extending in the direction of the arcuate portion by the contact plate construction, and it bears against an actuating member which may move it in a direction opposite to the bias direction. Fixed contact means are mounted in the housing in alignment with the movable contact means which are associated with the bridging members, and the movable contacts move into engagement with the fixed contact when the actuator is moved to displace the spring against the biasing thereof.

11 Claims, 14 Drawing Figures

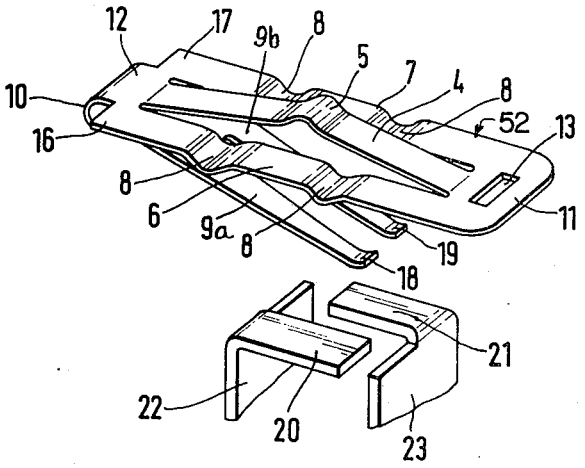
FIG. 4
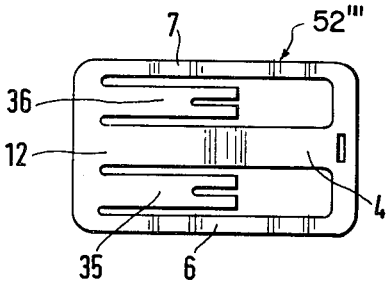
FIG. 11
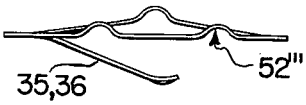
FIG. 12
FIG. 13
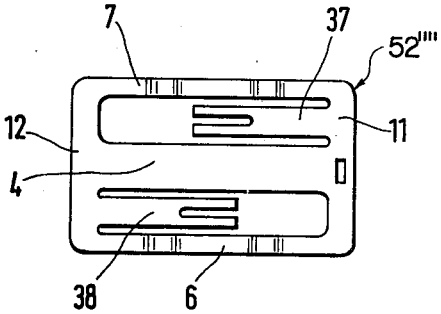
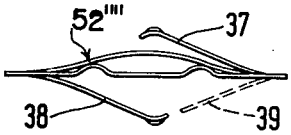
FIG. 14

ELECTRICAL SWITCH CONSTRUCTION

FIELD AND BACKGROUND OF THE INVENTION

This invention relates to electrical switches in general and, in particular, to a new and useful electrical switch comprising an electrical conducting, bowshaped spring having a central portion applying against an actuating, particularly, a displaceable member, and including lateral end portions supported for pivotal motion on fixed supports.

DESCRIPTION OF THE PRIOR ART

Switches are known in which the actuation spring is tensioned by engaging it on both sides, for example, in two opposite snap-in bearings, which are fixed to the casing. In seeking to make electrical switches of this kind as small as possible, this design of necessity leads to a particularly delicate spring. In consequence, an otherwise satisfactory strength being absent, the mounting of the spring requires extraordinary skill and great care.

SUMMARY OF THE INVENTION

The present invention is directed to a switch in which the spring is mounted in a simple manner and is less exposed to damages during its assembly.

In accordance with the invention, the spring is biased during the manufacture of the switch, so that the operation of its tensioning in the switch casing is omitted. It accordingly follows therefrom that it is then only necessary to insert the spring into a corresponding receiving structure of the switch in which it is of course secured against displacement. However, this supporting structure must be of a design such that it will avoid disturbance of the motion of the switching mechanism. It is sufficient, in itself, to secure the spring against rotation and displacement on one of its ends.

In an electrical switch having bridging members at both sides of a bow-shaped spring, a development of the invention provides that the bow-shaped spring and the bridging members are made of a planar metal sheet and at least the bridging members are each formed with an arcuate portion or they are bent. Because of the arcuate portion or portions, or the bending of the bridging members, the portion forming the spring must necessarily also bend, so that the entire system is then biased.

Arcuate portions are preferred in view of their greater rigidity. It is advantageous to provide an arcuate portion in the center of the bow-shaped spring also, which portion extends in the same direction as the spring is arched. Particularly with the manufacture in one piece and, consequently, the same thickness of the material, the briding members also deform under a force exerted on the spring by means of the switch actuating member. This member may advantageously comprise a key acting directly on the spring. The degree of deformation of the bridging members depends on their width, considered transversely of the direction of actuation, as well as their shape, for example, the number and form of the arcuate portions.

In a particularly preferred embodiment of the invention, an engaging element, preferably a bore or an aperture, for an engaging projection fixed to the casing is provided in the zone of one of the spring ends. For reasons of savings in manufacturing costs, it is also advantageous to provide a punched hole or aperture and to conform the casing projection thereto, which does not present a problem using a casing of plastic. It is also advantageous to choose a non-rounded, for example, rectangular cross-section for the aperture and the projection. This results in a secure holding of the element comprising the spring and the bridging members against rotation, as well as against displacement. The engagement is facilitated, of course, if the projection is tapered toward its free end.

Another variation of the invention provides that the spring is supported on at least one extension of the casing in the zone of its end opposite a free end, and that the fixed contact or contacts are disposed between the points of support of the two spring ends. The support may also be provided, for example, laterally of the respective spring end, i.e., at a point associated with the adjacent ends of the bridging members. In such a design, a three-point support is advantageously obtained if the location of the projection-aperture engagement is chosen exactly aligned with the spring on the opposite side.

In accordance with another embodiment of the invention, the bridging members form contact arms or elements at the same time. This is made possible due to the fact that, as already mentioned, upon pressing down the spring, the bridging members are deflected downwardly at the same time. The switching is thus effected in a snapping motion. It should also be noted that this switching mechanism is monostable and that the switching system comprising the spring and the bridging member or members automatically returns into its initial position as soon as the actuating force ceases to act. This switch is therefore particularly suitable as a key switch for business machines, such as typewriters, calculators, computers and the like.

In a switch having two bridging members, a development of the invention provides that each bridging member is associated with a fixed contact of its own. The current can then be supplied through one of the contacts and flow out through the other. The electrically conducting connection between the two bridging members is ensured by the manufacture in one piece with their spring. Another variation of the invention provides that the two fixed contacts are connected to each other in an electrically conducting manner, particularly formed by the forked inner end of a switch terminal element, and that the engaging projection is electrically conducting and is preferably formed by the inner end of another switch terminal element. As to their function, the two fixed contacts are to be considered a single fixed contact through which the current flows, for example, into the switch. The current then flows through the spring and the bridging members in the longitudinal direction to leave the switch at the other end of the spring through the engaging projection, or inversely. With an electrically non-conducting projection, an absolutely equivalent solution would be to provide the current passage in the zone of the projection.

In another embodiment of the invention, the spring is connected to, or preferably made in one piece with, at least one contact arm through a bent intermediate portion. This design provides a particularly large switching reserve made manifest by the fact that, in its return motion, the key covers a relatively considerable distance before the switching mechanism snaps back into its initial position. If, after switching, the key is somewhat released and then pressed again, no new switching operation is effected. This is necessary particularly for business machines where the keys are sometimes actuated very rapidly. In such cases, due to the elasticity of the fingers, the so-called finger-tip effect is produced causing unintentional and, primarily, undesirable double switching. In this inventive design, and also in the designs described above and in the following, the switch is well secured against such errors.

In a very advantageous manner, the contact arm is forked at least on its free end, and each prong cooperates with a single fixed contact. In this design again, the current may be supplied, for example, through one of the fixed contacts, and leave through the other. In this case, a development of the invention provides that the fixed contacts are formed by the free ends of oppositely angled switch terminal elements. To obtain a position in which they are adjacent each other, the left half of the one end and the right half of the other end, considered in the transverse direction, may be cut off.

Another embodiment of the invention provides that at least one contact arm, or one at each side, is disposed above or below a slot formed between the spring and at least one of the bridging members. This contact arm may also be made in a one piece construction with the spring or the bridging member or members, which makes the latter initially lie in the same plane as the arm. Upon biasing the spring, the contact arm or arms are bent out of the plane of the spring or the plane of the bridging members. If two contact arms are provided, they may be bent in the same or in opposite directions. They may be punched so as to extend in the same or in opposite directions. It follows therefrom that, advantageously, such two contact arms pointing with their free ends in opposite directions may be provided even between the spring and each of the bridging members. Here again, it is possible to bend them in the same, or in opposite directions.

Accordingly, it is an object of the invention to provide an electrical switch comprising first and second spaced apart fixed supports with an actuating member movable relative to said supports, and an electrically conducting bow-shaped spring having a central spring portion applying against the actuating member and having lateral end portions supported for pivotal motion on the fixed supports, with the bow-shaped spring having at least one bridging member connecting the respective opposite ends thereof and extending laterally of the plane of motion of the spring.

A further object of the invention is to provide an electrical switch which comprises a casing of a non-conductive material having first and second spaced apart upstanding supports with a contact plate of electrically conductive material having an intermediate spring portion with an outwardly extending arcuate portion thereof intermediate its length and a bridging member on each side of the spring portion and an end porition at each end interconnecting said spring portion of at least one of said bridging members, said spring porition being supported over said upstanding supports on each end portion and with movable contact means associated with said bridging members being movable by deflection of said spring portion and, wherein, the spring portion is held by the contact plate in an outwardly biased condition extending in the direction of the arcuate portion and including fixed contact means mounted in the housing in alignment with the path of movement of said movable contact means and an actuator mounted in the housing for movement toward and away from the spring portion and engageable with the spring portion to displace it against the biasing thereof to move the movable contact means into engagement with the fixed contact means.

A further object of the invention is to provide an electrical switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 4 is an exploded perspective view of the contact plate disposed in respect to the fixed contacts;

FIG. 11 is a top plan view of another embodiment of switch plate;

FIG. 12 is an end view of the switch plate shown in FIG. 11;

FIG. 13 is a plan view of another embodiment of switch plate; and

FIG. 14 is an end view of the switch plate shown in FIG. 13.

DESCRIPTION OF THE PREFERRED EMBODIMENTS

Figure 1:
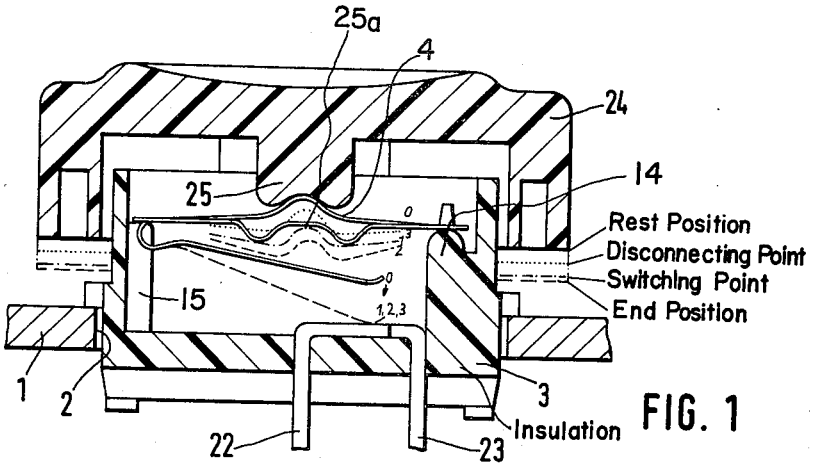
FIG. 1 is a vertical longitudinal sectional view of a switch constructed in accordance with the invention.

Referring to the drawings in particular, the invention embodied therein, comprises, a switch, generally designated 50, which includes a contact switch plate, generally designated 52, which is supported on spaced apart supports 14 and 15 in a housing or casing 3 in a position so that movable contact means, which in this embodiment comprise contact prongs or ends 18 and 19, may be moved into engagement with fixed contact means 20 and 21 by an actuator, such as an actuator key 24, which engages over a bulge portion or arcuate portion 5 of a spring member or spring portion 4 of the contact plate 52.

In all of the embodiments of the invention, the switches are key switches, generally designated 50, and preferably of a type to be mounted in business machines or the like. They are usually mounted or arranged in longitudinal and transverse rows and supported in a plate 1, which is provided with an aperture 2 in which a housing or casing 3 of the switch 50 is received. For this purpose, as a rule, an aperture with a rectangular or square cross-section is provided.

The switch 50 of the embodiment shown in FIGS. 1 to 4 includes a spring contact plate 52 having a central bow-shaped spring portion 4, the shape of which may be learned particularly well from FIG. 4. The spring contact plate 52 has, in its center, an arcuate portion 5 extending outwardly in the direction in which the spring is arched. At each side of the central bow-shaped spring 4, there is a respective bridging member 6 and 7. Each bridging member 6 and 7 has two axially spaced inflections or arcuate portions 8 which are, however, arched in a direction opposite to that of portion 5 of the spring plate 52. They make it possible to obtain the necessary bias of the bow-shaped spring portion 4. Since spring portion 4 and bridging members 6 and 7 are made in one piece from a planar metal sheet and a connecting or end portion 11 and 12 is formed on each end of the sheet, end portion 12 is joined to a contact arm 9 through a bent intermediate piece 10. Preferably, a rectangular aperture 13 is punched in the connecting portion 11 into which, in an assembled state, a projection 14 of casing 3, tapered toward its free end and having a corresponding cross-section, is engaged. The spring and the members or portions connected thereto, or made in one piece therewith, are thereby secured against both displacement and rotation, without hindering the switching operation.

Figure 3:
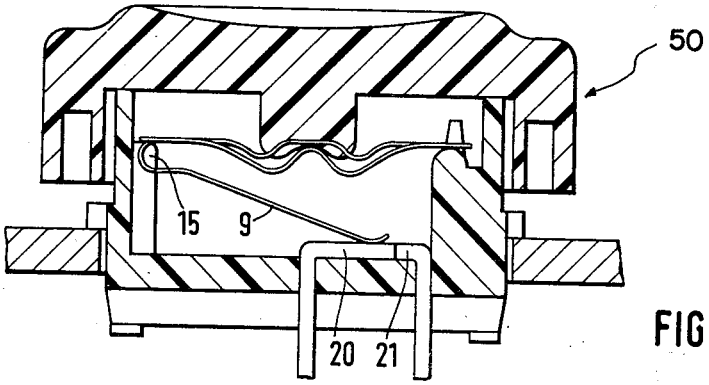
FIG. 3 is a view similar to FIG. 2 with the switch part shown in an actuated position.

The lateral spacing depends on the width of the spring and the supporting points are disposed and spaced from each other in the direction perpendicular to the drawing plane (FIG. 3). In this way, a very advantageous three-point support is obtained, with the ends 16 and 17 of connecting portion 12 which extend laterally of the lefthand spring end (FIG. 4) resting on supports 15.

Contact arm 9 is feathered or forked and includes laterally spaced apart legs 9*a* and 9*b* with ends or prongs 18 and 19, respectively, engageable with fixed contacts 20 and 21. The slightly bent free ends of prongs 18 and 19 form the movable contacts. The fixed contacts are formed by the inner ends of switch terminal elements 22 and 23.

Figure 2:
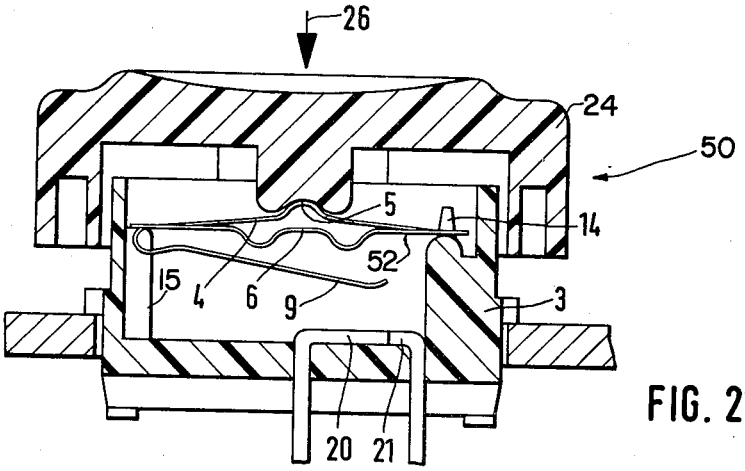
FIG. 2 is a view similar to FIG. 1 with the switch part shown in a non-actuated position.

Switch actuating key 24 is provided on its inside with a pin-shaped extension 25, preferably having a concave end face 25*a*. This face 25*a* engages over the arcuate portion 5 of spring 4, as shown in FIG. 2. As soon as actuating key 24 is pressed down in the direction of the arrow 26, and the switch point 1 is reached (this position is indicated in FIG. 1 at "1"), contact arm 9 with the movable contacts 18 and 19 snaps from its initial position shown in FIG. 2 into its switched position, shown in FIG. 3. The fixed contacts are thereby bridged and the circuit in which the switch is connected is closed. The end position of this switching operation is indicated at "2". The disconnecting position "3" is intermediate between the rest position "0" and the switch position "1", as shown in FIG. 1. It may be learned from this showing that the switch reserve is relatively large.

Figure 5:
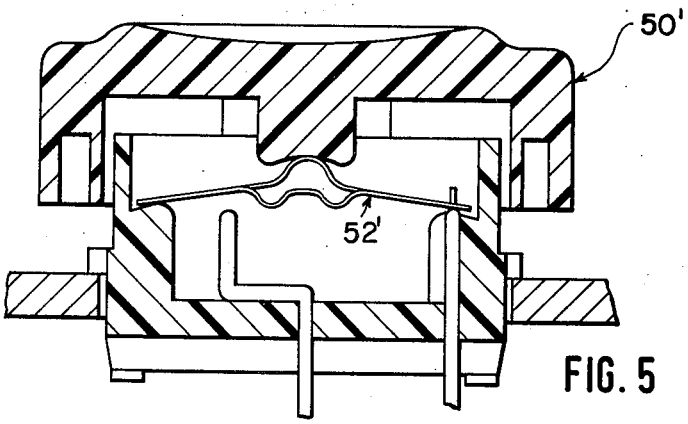
FIG. 5 is a view similar to FIG. 2 of another embodiment of the invention.
Figure 6:
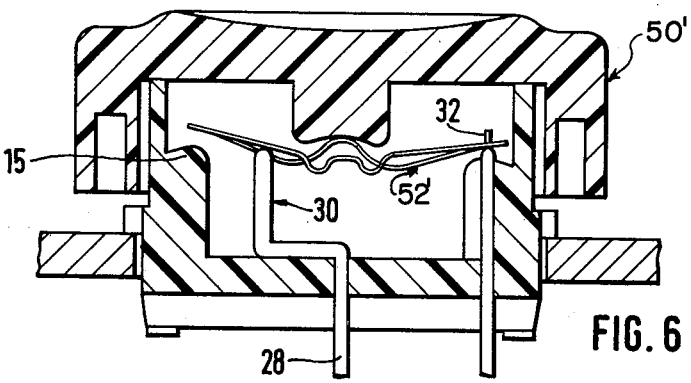
FIG. 6 is a view similar to FIG. 5 showing the switch in an actuated position.
Figure 7:
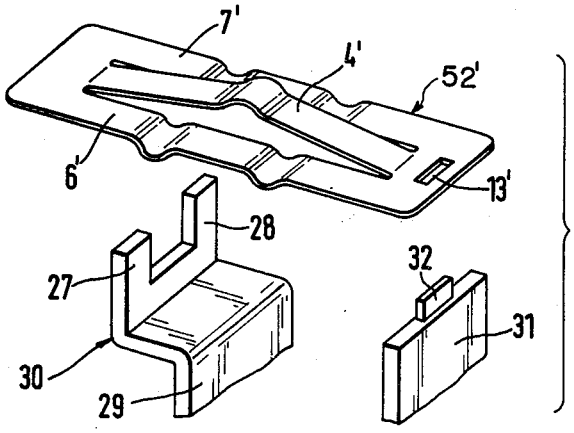
FIG. 7 is an exploded perspective view of another embodiment of the switch contact plate.

In the embodiment of FIGS. 5 to 7, a switch 50' includes a contact spring 52', wherein a joined contact arm 9, similar to the switch of the embodiment of FIGS. 1 to 4 is omitted. The contact is effected directly through two bridging members 6' and 7', in cooperation with fixed contacts 27 and 28 which, since they are made in one piece with the switch terminal element 29, function as a single fixed contact and provide only a two-point support. The switch terminal element 30 is twice angled in opposite directions and is forked.

The inner end of the other switch terminal element 31 is formed with a projection 32 engaging into a slot 13' of the righthand end (FIG. 7) of the element comprising spring plate 4', having bridging members 6' and 7'. The peculiarity of the switch operation in this variation of the invention may be learned from FIG. 6. That is, in the switch position, the free end, i.e., in FIG. 6, the lefthand end of the snapping mechanism, is completely lifted from its supports 15. Only a pivotal motion takes place at projection 32.

Figure 8:
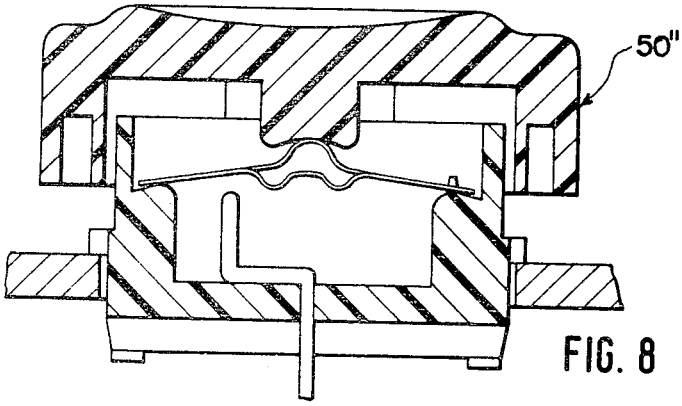
FIG. 8 is a view similar to FIG. 2 of still another embodiment of the invention.
Figure 9:
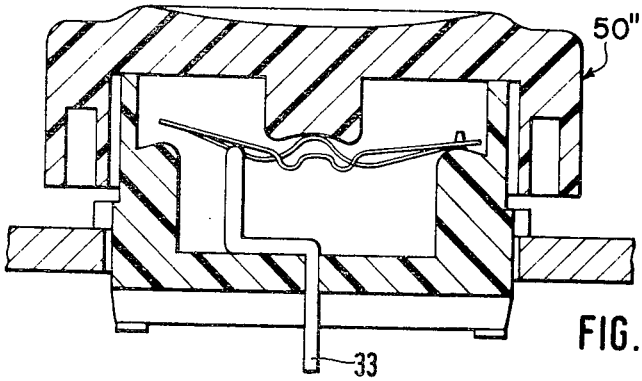
FIG. 9 is a view similar to FIG. 8 showing the switch in an actuated position.
Figure 10:
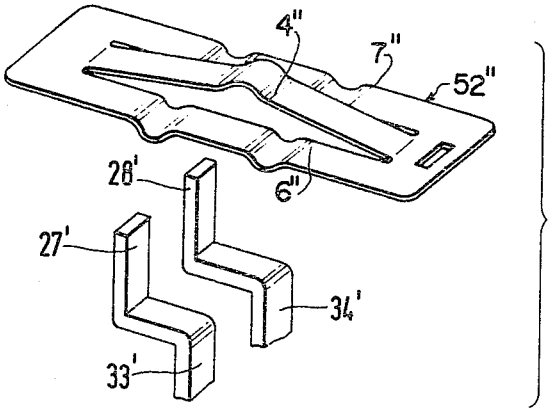
FIG. 10 is a view similar to FIG. 4 of another embodiment of switch plate.

The embodiment of the invention shown in FIGS. 8 to 10, comprises a switch 50'' which is substantially identical with that of FIGS. 5 to 7, except that the two fixed contacts 27' and 28' are not connected to each other, but are each formed by the twice angled inner end of a respective switch terminal element 33 and 34. The current is supplied through one of these terminal elements and, in the closed position of the switch, leaves through the other element.

In the switch of FIGS. 1 to 4, contact arm 9 is connected to the bow-shaped spring plate 4 or connecting portion 12 by means of bent intermediate piece 10. As shown in FIGS. 11 and 13, contact switch plates 52''' and 52'''' including at least one contact arm 35, 36, or 37, 38 may also be provided in the slot between spring portion 4 and one of the bridging members 6 or 7. These contact arms again are made in one piece with the spring and the bridging members, more particularly, they are punched out of a planar metal sheet.

In FIG. 12, the two contact arms 35 and 36 are bent downwardly in the same direction, similar to the showing of FIG. 4 while, according to FIG. 14, contact arm 37 is bent upwardly and contact arm 38 is bent downwardly from the plane of the sheet. Dotted line 39 indicates that contact arm 37 might also be full length and bent downwardly, which design may even be more important than that shown in solid lines in FIG. 14.

According to FIG. 11, the free ends of contact arms 35 and 36 point in the same direction, while according to FIG. 13, they are oriented oppositely. In FIG. 11, contact arms 35 and 36 both extend from connecting portion 12, while in FIG. 13, contact arm 37 extends from connecting portion 11 and contact arm 38 extends from connecting portion 12. It may easily be understood that with slightly shorter contact arms, two of them may be provided in each slot between the bow-shaped spring 4 and the respective bridging member 6, 7.

While specific embodiments of the invention have been shown and described in detail to illustrate the application of the principles of the invention, it will be understood that the invention may be embodied otherwise without departing from such principles.

What is claimed is:

1. An electrical switch, comprising, a casing of nonconductive material having first and second spaced apart upstanding supports, a contact plate of electrically conductive material having an intermediate spring portion with an outwardly extending arcuate intermediate portion thereof centrally disposed intermediate its length, a bridging member on each side of said spring portion, and an end portion on each end interconnecting said spring portion with said bridging members, said spring portion having each end portion supported on respective ones of said upstanding supports, movable contact means connected with said contact plate and being movable by deflection of said spring portion, said spring portion extending from said bridging members in an outwardly biased condition in the direction of said arcuate portion, fixed contact means mounted in said casing in alignment with the path of movement of said movable contact means, and an actuator mounted in said casing for movement toward and away from said spring portion and engageable with said arcuate portion of said spring portion to displace it against the biasing thereof to move said movable contact means into engagement with said fixed contact means, said end portions of said contact plate remaining supported on said supports, said biasing being sufficient to return said spring portion to its outwardly biased condition after said actuator is released.

2. An electrical switch, as claimed in claim 1, wherein said first support includes a projection, said contact plate having a slot into which said projection engages to support said contact plate in said housing.

3. An electrical switch, as claimed in claim 1, wherein said bridging members have at least a portion comprising said movable contact means.

4. An electrical switch, as claimed in claim 1, wherein said fixed contact means include first and second spaced contact terminals, said movable contact means comprising said bridging members which are aligned with respective ones of said first and second contact terminals.

5. An electrical switch, as claimed in claim 1, wherein said fixed contact means comprises a terminal member having spaced apart contact portions, said movable contact means comprising said bridging members on each side of said spring portion positionable to engage with said spaced apart contact portions, said contact plate including an end portion having a slot therein, said fixed contact means also including a second fixed contact terminal having a projection engageable into the slot of said contact plate and comprising one of said first and second upstanding supports and supporting said plate thereon.

6. An electrical switch, as claimed in claim 1, wherein said movable contact means includes an intermediate piece connected to said contact plate and having a forked end with first and second leg portions terminating in contact pieces, said fixed contact means including first and second spaced apart fixed contact elements engageable by said contact pieces.

7. An electrical switch, as claimed in claim 1, wherein said fixed contact means comprises first and second spaced apart terminal members mounted in said casing, an intermediate piece connected to said plate and having first and second spaced apart legs forming said movable contact means engageable with respective ones of said first and second terminal members.

8. An electrical switch, as claimed in claim 1, wherein said contact plate includes a contact arm connected to each end portion being of a length less than the length of said plate so as not to be connected to the other of the end portions, each of said contact arms having an end extending out of the plane of said plate terminating in a contact.

9. An electrical switch, as claimed in claim 8, wherein each of said contact arms extends outwardly from the plane of said contact plate in the same direction and they are both connected to the same respective end portion of said plate.

10. An electrical switch, as claimed in claim 8, wherein one of said contact arms extends in an opposite direction from the other of said contact arms, and is connected to an end portion of said contact plate which is opposite the end portion connected to the other of said contact arms.

11. An electrical switch, comprising, a casing of non-conductive material having first and second spaced apart upstanding supports, a contact plate of electrically conductive material having an intermediate spring portion with an outwardly extending arcuate intermediate portion thereof centrally disposed intermediate its length, a bridging member on each side of said spring portion, and an end portion on each end interconnecting said spring portion with said bridging members, said spring portion having each end portion supported on respective ones of said upstanding supports, movable contact means connected with said contact plate and being movable by deflection of said spring portion, said spring portion extending from said bridging members in an outwardly biased condition in the direction of said arcuate portion, fixed contact means mounted in said casing in alignment with the path of movement of said movable contact means, and an actuator mounted in said casing for movement toward and away from said spring portion and engageable with said arcuate portion of said spring portion to displace it against the biasing thereof to move said movable contact means into engagement with said fixed contact means, said end portions of said contact plate remaining supported on said supports, said biasing being sufficient to return said spring portion to its outwardly biased condition after said actuator is released, said movable contact means including an intermediate piece connected to said contact plate and having a forked end with first and second leg portions terminating in contact pieces, said fixed contacts including first and second spaced apart fixed contact elements engageable by said contact pieces.

* * * * *